US010781546B2

(12) United States Patent
Mathews

(10) Patent No.: US 10,781,546 B2
(45) **Date of Patent: *Sep. 22, 2020**

(54) SHIFT MECHANISM FOR A TUFTING MACHINE

(71) Applicant: Card-Monroe Corp., Chattanooga, TN (US)

(72) Inventor: Ricky E. Mathews, Sale Creek, TN (US)

(73) Assignee: Card-Monroe Corp., Chattanooga, TN (US)

( * ) Notice: Subject to any disclaimer, the term of this patent is extended or adjusted under 35 U.S.C. 154(b) by 18 days.

This patent is subject to a terminal disclaimer.

(21) Appl. No.: 16/185,082

(22) Filed: Nov. 9, 2018

(65) Prior Publication Data

US 2019/0078246 A1 Mar. 14, 2019

Related U.S. Application Data

(63) Continuation of application No. 15/459,300, filed on Mar. 15, 2017, now Pat. No. 10,156,035.

(51) Int. Cl.
*D05C 15/30* (2006.01)
*D05B 69/12* (2006.01)

(52) U.S. Cl.
CPC ..... *D05C 15/30* (2013.01); *D05B 69/12* (2013.01)

(58) Field of Classification Search
CPC ..... D05B 69/12; D05C 15/08; D05C 15/10; D05C 15/12; D05C 11/06
See application file for complete search history.

(56) References Cited

U.S. PATENT DOCUMENTS

| | | | |
|---|---|---|---|
| 3,109,395 | A | 11/1963 | Batty et al. |
| 3,964,407 | A | 6/1976 | Ingram et al. |
| 3,964,408 | A | 6/1976 | Smith |
| 3,972,295 | A | 8/1976 | Smith |
| 4,109,593 | A | 8/1978 | Barnes et al. |
| 4,173,192 | A | 11/1979 | Schmidt et al. |

(Continued)

FOREIGN PATENT DOCUMENTS

| | | | |
|---|---|---|---|
| CN | 208933643 | U | 6/2019 |
| GB | 2242205 | A | 9/1991 |
| JP | 8003859 | A | 1/1996 |

OTHER PUBLICATIONS

Nexen Group, Inc.; *RPS Roller Pinion*; http://www.nexengroup.com/nxn/nxns/Roller+Pinion+System/Nexen%20Pinion%20Selection%20Interactive%20v081915.pdf#search=roller%20pinion; 2014.

(Continued)

*Primary Examiner* — Nathan E Durham
(74) *Attorney, Agent, or Firm* — Womble Bond Dickinson (US) LLP

(57) ABSTRACT

A shift mechanism for a tufting machine for controlling the transverse, lateral shifting movement of a series of needles of the tufting machine across a backing material for forming a series of cut and/or loop pile tufts of yarns in the backing in accordance with a pattern. The shift mechanism will include a motor controlled rack and pinion shift control assembly having one or more pinions, each driven by a motor, that engage and drive a rack coupled to at least one needle bar of the tufting machine, for controlling the transverse shifting movement of the needles.

15 Claims, 5 Drawing Sheets

(56) References Cited

U.S. PATENT DOCUMENTS

| | | | |
|---|---|---|---|
| 4,282,818 | A | 8/1981 | Ingram |
| 4,399,758 | A | 8/1983 | Bagnall |
| 4,440,102 | A | 4/1984 | Card et al. |
| 4,445,447 | A | 5/1984 | Bardsley |
| 4,483,260 | A | 11/1984 | Gallant |
| 4,501,212 | A | 2/1985 | Slattery |
| 4,597,344 | A | 7/1986 | Stutznacker |
| 4,653,293 | A | 3/1987 | Porat |
| 4,653,413 | A | 3/1987 | Bagnall |
| 4,662,291 | A | 5/1987 | Bardsley |
| 4,759,199 | A | 7/1988 | Prichard |
| 4,829,917 | A | 5/1989 | Morgante et al. |
| 5,392,723 | A | 2/1995 | Kaju |
| 5,427,039 | A | 6/1995 | Bagnell |
| 5,461,996 | A | 10/1995 | Kaju |
| 5,526,760 | A | 6/1996 | Ok |
| 5,555,826 | A | 9/1996 | Shatterfield |
| 5,562,056 | A | 10/1996 | Christman, Jr. |
| 5,566,630 | A | 10/1996 | Burgess et al. |
| 5,515,228 | A | 11/1996 | Padgett, III |
| 5,572,939 | A | 11/1996 | Beatty |
| 5,645,001 | A | 7/1997 | Green et al. |
| 5,706,745 | A | 1/1998 | Neely et al. |
| 5,743,200 | A | 4/1998 | Miller et al. |
| 5,794,551 | A | 8/1998 | Morrison et al. |
| 5,806,446 | A | 9/1998 | Morrison et al. |
| 5,979,344 | A | 11/1999 | Christman, Jr. |
| RE37,108 | E | 3/2001 | Neely |
| 6,244,203 | B1 | 6/2001 | Morgante et al. |
| 6,283,052 | B1 | 9/2001 | Pratt |
| 6,439,141 | B2 | 8/2002 | Morgante et al. |
| 6,550,407 | B1 | 4/2003 | Frost et al. |
| 6,807,917 | B1 | 10/2004 | Christman et al. |
| 6,827,030 | B2 | 12/2004 | Hicks |
| 7,284,492 | B2 | 10/2007 | Johnston |
| 7,426,895 | B2 | 9/2008 | Smith et al. |
| 7,431,974 | B2 | 10/2008 | Lovelady et al. |
| 7,438,007 | B1 | 10/2008 | Hall |
| 7,597,057 | B2 | 10/2009 | Johnston et al. |
| 7,836,836 | B2 | 11/2010 | Brewer |
| 8,082,861 | B2 | 12/2011 | Lovelady et al. |
| 8,201,509 | B2 | 6/2012 | Christman, Jr. |
| 8,210,113 | B1 * | 7/2012 | Ellis ..... D05B 23/005 112/119 |
| 8,240,263 | B1 | 8/2012 | Frost et al. |
| 8,671,858 | B2 | 3/2014 | Morgante et al. |
| 9,260,810 | B2 | 2/2016 | Neely et al. |
| 9,644,297 | B2 | 5/2017 | Mathews |
| 10,156,035 | B2 | 12/2018 | Mathews |
| 2004/0000261 | A1 | 1/2004 | Stutznacker |
| 2008/0134949 | A1 | 6/2008 | Bearden |
| 2010/0132601 | A1 | 6/2010 | Nakagawa et al. |
| 2010/0224113 | A1 | 9/2010 | Morgante et al. |
| 2014/0272260 | A1 | 9/2014 | Weiner et al. |
| 2018/0266027 | A1 | 9/2018 | Mathews |

OTHER PUBLICATIONS

Design World; *Rack-and-Pinion Sets; How they work*; www.designworldonline.com; Aug. 2015.

Nexen Group, Inc.; *RPS Racks*; http://www.nexengroup.com/nxn/nxns/Roller+Pinion+System/Nexen%20Rack%20Selection%20Selection%20Interactive.pdf ; 2014.

The International Search Report and the Written Opinion Application No. PCT/US2018/021947, dated Jul. 20, 2018.

International Preliminary Report on Patentability and Written Opinion of the International Searching Authority of International Application No. PCT/US2018/021947 dated Sep. 26, 2019.

* cited by examiner

SHIFT MECHANISM FOR A TUFTING MACHINE

CROSS REFERENCE TO RELATED APPLICATIONS

The present Patent Application is a Continuation of co-pending U.S. patent application Ser. No. 15/459,300, filed Mar. 15, 2017. The specification and drawings of the Patent Application referenced above are specifically incorporated herein by reference as if set forth in their entireties.

FIELD OF THE INVENTION

The present disclosure generally relates to tufting machines and features thereof for forming tufted articles such as carpets. In particular, the present disclosure relates to a tufting machine with a shift mechanism for shifting one or more needle bars of the tufting machine in order to form tufted articles such as carpets, rugs and/or artificial turf products.

BACKGROUND OF THE INVENTION

Patterned tufted articles, such as carpets, have become increasingly popular, particularly in commercial market segments including carpet tiles and hospitality carpets. Carpets having various patterned designs generally can be created by controlling the feeding of yarns, such as through pattern yarn feed attachments, and by shifting the needles of the tufting machine. In forming patterned tufted articles utilizing one or more shifting needle bars, it is important for the needle bars to be shifted or stepped as precisely as possible in order to tuft the yarns or colors of yarns at the tuft or stitch locations required by the pattern being tufted with a necessary sharpness, clarity and accuracy for the formation of the tufted pattern. It also generally is important for the needles to be shifted within as short a time as possible between the time the needles clear the backing and before they re-enter the backing during the downward stroke of their reciprocation cycle. The faster such a shifting movement can be accomplished, the faster the needles can be reciprocated, so as to provide for increased or enhanced production rates. Thus, the speed at which the needle bar or needle bars are shifted generally must be balanced with controlling such shifting movement as accurately as possible to properly present the yarns carried by the needles to their required stitch locations according to the pattern being tufted.

Previously, cam-operated shifters, hydraulic shifters and servomotor-driven shift mechanisms have been used to shift the needle bars of tufting machines. For example, U.S. Pat. No. 5,979,344 of Christman, Jr., et al. discloses a "Tufting Machine with Precision Drive System," including a roller screw actuator-driven shift mechanism, while U.S. Pat. No. 6,283,052 of Pratt, et al. discloses a tufting machine shifter having a linear motor. However, needle bars, especially those required for larger size tufting machines, typically are heavy, creating substantial inertia that must be overcome both in starting and for stopping the shifting movement of a needle bar(s). Overcoming such inertia and accurately and consistently controlling the movement of the needle bar(s), particularly when multiple shift steps or jumps or shifting movements of more than one gauge step are called for in the pattern, can be difficult to accomplish in a very short time span.

Accordingly, it can be seen that a need exists for a tufting machine and a shift mechanism for controlling the shifting of the needles of a tufting machine that addresses the foregoing and other related and unrelated problems in the art.

SUMMARY OF THE INVENTION

Briefly described, the present invention generally relates to tufting machines and a shift mechanism for use with tufting machines for controlling the shifting of the needles of the tufting machine with enhanced precision and accuracy in order to form tufted articles such as carpets. The tufting machine generally will include a frame, backing feed rolls feeding a backing material through a tufting zone, and one or more needle bars having a series of spaced needles mounted therealong. For example, the tufting machine can have a single needle bar with a series of needles arranged in an in-line or in a staggered configuration and spaced transversely along the length of the needle bar, such as at a selected or prescribed gauge (i.e., $\frac{1}{8}^{th}$", $\frac{1}{10}^{th}$", $\frac{1}{16}^{th}$", $\frac{5}{32}^{nd}$", $\frac{5}{64}^{th}$", etc. . . . ). Alternatively, a pair of shifting needle bars can be used, with each of the needle bars having a series of needles mounted at selected spacings and arranged in an in-line or a staggered configuration, and with the needles of the needle bars (i.e., front and rear needle bars) further being separated by a longitudinal stagger or distance in the longitudinal direction of feeding of the backing material through the tufting zone.

Each needle bar generally will be driven by a drive system or assembly so as to move its needles along a vertically reciprocating movement or stroke into and out of the backing. As the needles penetrate the backing, they carry a series of yarns carried by the needles into the backing during each cycle or stroke. The yarns can be fed to each of the needles by one or more yarn feed mechanisms, for example, by single-end or double-end yarn feed mechanisms or attachments, such as an Infinity™ of an Infinity IIE™ yarn feed pattern attachment as manufactured by Card-Monroe Corp., or a scroll, roll or other pattern attachment. The needles further will be engaged by a series of gauge parts, such as loop pile loopers, cut pile hooks, level cut loop loopers, etc., for forming a series of loop and/or cut pile tufts of yarns in the backing.

The needle bar(s) of the tufting machine also generally will be slidably mounted onto the frame of the tufting machine, so as to be movable transversely across the backing material as it is fed through the tufting zone, and will be linked to the shift mechanism, which controls the lateral or transverse shifting movement of the needles as the needles are reciprocated vertically. In one embodiment, the shift mechanism according to the present disclosure can comprise a shift control assembly or system coupled to the at least one needle bar of the tufting machine in a substantially in-line, direct drive arrangement for controlling the transverse shifting movement of the needles. Where the tufting machine utilizes multiple independently shiftable needle bars, each needle bar can be connected to and shifted transversely by a separate shift mechanism. Alternatively, if the needle bars are to be controlled or shifted together in substantially the same direction, both needle bars could be connected to a single shift mechanism.

The shift control assembly generally can include at least one servo driven line or motor mounted to the frame of the tufting machine. The linear motor further can include a body or housing with a drive plate or forcer received therein. A series of magnets will be provided along upper and lower edges and/or along the sides of the drive plate or forcer, and hold effect or similar sensors can be mounted along the drive plate. Guide rails, which can include linear bearing guides and tracks, also can be located adjacent the upper and lower edges of the drive plate to help guide and control the linear, back and forth movement of the drive plate. One or more linear motors are located along one or both sides of the drive plate, and will generate electromagnetic fields for driving the linear motion of the drive plate.

The drive plate will be directed linked or connected to the needle bar such that the linear motion of the drive plate or forcer will be translated to the needle bar for shifting the needle bar transversely. One or more sensors can also be provided within the housing of the drive assembly to provide feedback as to the position of the drive plate as it is moved linearly. The tufting machine controller, or a server or other control system can receive the feedback from the sensor(s) and will include programming for controlling operation of the motors to control the linear movement of the drive plate, and thus the transverse shifting motion of the needle bar for a desired or selected distance or number of shift steps in accordance with a tufted pattern being formed.

Various features, objects and advantages of the present invention will become apparent to those skilled in the art upon a review of the following detailed description, when taken in conjunction with the accompanying drawings.

Figure 1:
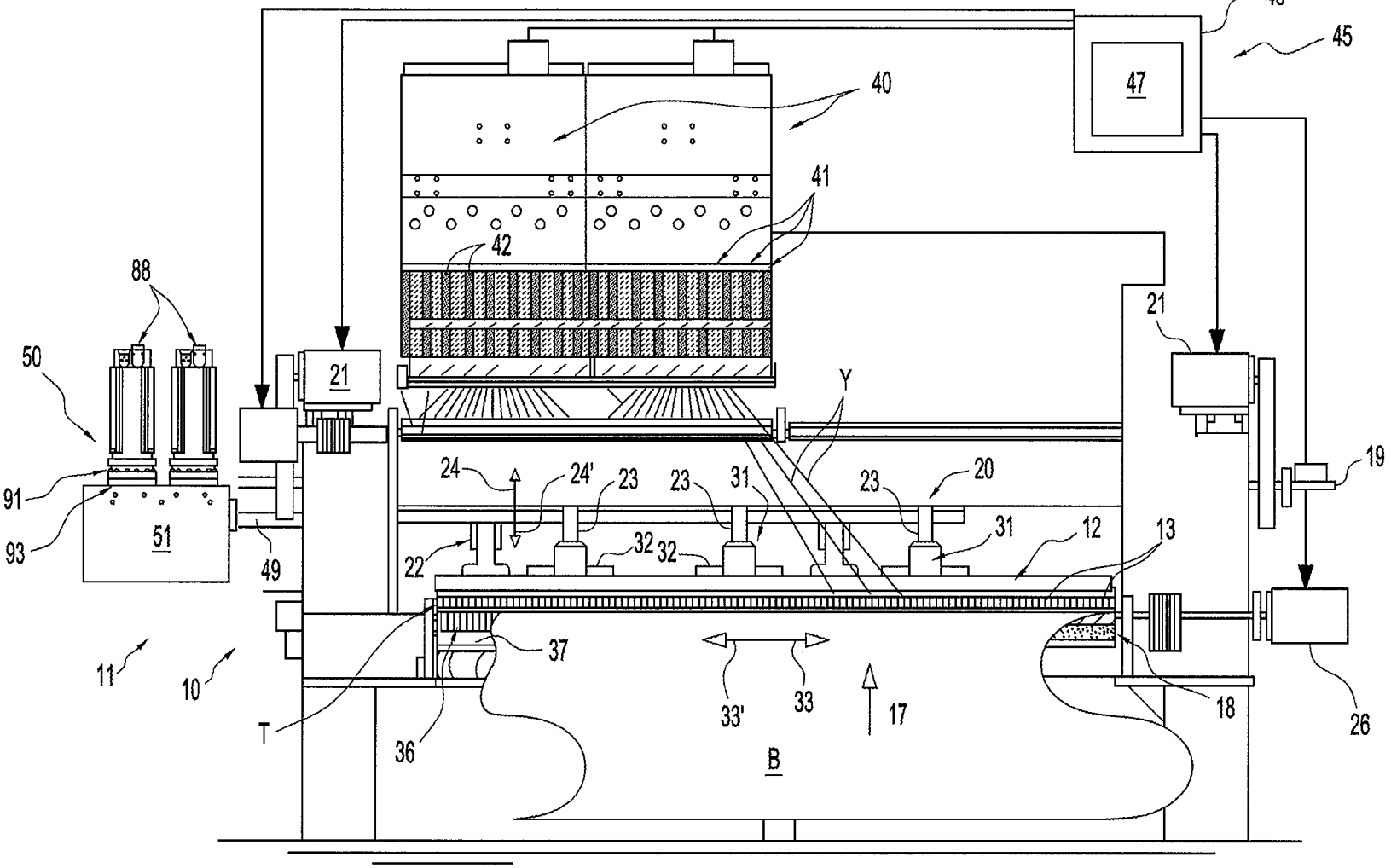
FIG. 1 is an end view of a tufting machine with a shift mechanism according to the principles of the present invention.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments and/or features of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION OF THE INVENTION

Referring now to the figures in which like numerals indicate like parts throughout the several views, FIG. 1 illustrates a tufting machine 10 with a shift mechanism 11 (FIGS. 2-5) for controlling the lateral or transverse shifting movement of one or more needle bars 12 (FIG. 1) carrying a series of needles 13, as the needle bar or needle bars are further reciprocated in a vertical direction in a cycling or stroke motion so as to cause the needles 13 to move and/or penetrate into and out of a backing material B as the backing material is moved through a tufting zone T of the tufting machine. The shift mechanism 11 is generally designed to provide enhanced control and accuracy in the transverse shifting movement of the needles across the backing material B to selected pattern stitch or tuft locations as the needles are reciprocated into and out of the backing material, even at increased production speeds, so as to facilitate the formation of patterned tufted articles with enhanced accuracy and dimensional stability at such increased production speeds.

As generally illustrated in FIG. 1, the tufting machine 10 can include a frame 16 defining the tufting area or zone T through which the backing material B is fed in a longitudinal direction along a path of travel or feed direction indicated by arrow 17, by a series of backing feed rolls 18. A main driveshaft 19 generally will be located along the frame 16, typically extending laterally thereacross, and can be driven by one or more motors 21. The main driveshaft further can be engaged by and will drive a needle bar drive assembly or system 20, which typically can include a series of bearing guides 22 and a series of pusher rods 23 coupled to the main shaft so as to be driven in a reciprocating, substantially up and down motion or cycle, in a first or vertical direction indicated by arrows 24/24', as the main driveshaft is rotated by operation of its one or more drive motors. As further indicated in FIG. 1, the needle bar(s) 12 will be coupled or connected to each of the series of pusher rods 23 so as to be carried along the vertically reciprocating motion or cycle with the movement of the pusher rods 23 by operation of the main driveshaft 19 of the tufting machine 10. As a result, the needles 13 mounted along the needle bar(s) 12 will be carried in a reciprocating motion or stroke into and out of the backing material B, between a raised or top position, and a lowered or bottom position penetrating through the backing material B.

The backing feed rolls 18 that feed the backing material along its longitudinal path 17 through the tufting zone T each can be driven by a drive motor 26, which can be operated in concert or conjunction with the operation of the motor(s) 21 that drive the main driveshaft 19 of the tufting machine. Alternatively, the backing feed rolls can be driven off of the main driveshaft, such as through the use of timing belts or other linkages connecting the backing feed rolls to the main driveshaft and/or its motor, so as to drive the backing feed rolls substantially directly off of or by the operation of the main driveshaft.

As further indicated in FIG. 1, the needle bar 12 generally will be slidably coupled or connected to the push rods 23 of the needle bar drive system 20, such as by sliding brackets or bearing assemblies 31. The needle bar also can include a series of guide rails or tracks 32, which can be slidably received within the brackets 31 to which the ends of the push rods are mounted, for guiding the transverse or lateral shifting movement of the needle bar in a second direction indicated by arrows 33 and 33', whereby the needles are shifted or moved transversely across the backing material B under control of the shift mechanism 11. In one example embodiment, the needle bar can be mounted to or slidably supported in engagement with the push rods 23 of the needle bar drive assembly or system 22 by a series of linear bearing assemblies 31, such as disclosed in U.S. Pat. No. 9,260,810, the disclosure of which is incorporated by reference as if set forth fully herein. As a result, as the needles 13 are reciprocated vertically in their first direction indicated by arrows 24/24', penetrating into and out of the backing material B, the needles 13 also can be shifted in their second or transverse direction, as indicated by arrows 33 and 33'. The needles 13 further can be moved transversely in a desired or prescribed number of shift steps or jumps, that can, for example, be based upon a gauge spacing between each of the needles 13 carried by the needle bar 12 or needle bars, or at some multiple thereof to form a desired pattern. In addition, the shift mechanism 11 can shift the needles by other selected or desired step lengths or distances, including moving the needles by ½ gauge or other off-gauge steps or spacings.

It further will be understood by those skilled in the art that while the Figures, for example FIG. 1, illustrate the use of a single needle bar 12 with a series of needles 13 spaced along the length of the needle bar extending across the tufting area, the shift mechanism 11 of the present invention further can be operable for use with multiple shifting needle bars, i.e., 2 or more independently shiftable needle bars. It also will be understood that the needles 13 can be arranged along a single needle bar or along each of multiple needle bars in a substantially inline or in a staggered configuration. The spacing of the needles along each needle bar further typically can be arranged according to a desired gauge or spacing, such as 14", ⅛", 1/10", 1/16", 5/32"; however, other positional arrangements or spacings for the needles also can be used, for example, including various half-gauge or other spacings. In addition, in tufting machines utilizing dual or multiple shifting needle bars, the needles of each needle bar also can be offset or longitudinally staggered by the desired distance or spacing, e.g., ¼"-⅜", and/or with the needles of each needle bar further being laterally offset or spaced apart, although the needles further could be arranged in inline arrangements along each needle bar and with the needles of each needle bar also being substantially longitudinally aligned as well.

As FIG. 1 additionally illustrates, a series of yarns Y will be fed to each of the needles 13 so as to be carried with the needles 13 as the needles penetrate and are reciprocated into and out of the backing material B. As the needles penetrate the backing and move toward a lower, bottom position of their reciprocating stroke or cycle, the needles will be engaged by a series of gauge parts 36 mounted below the backing and along the tufting zone T of the tufting machine. The gauge parts 36 can include loop pile loopers, cut pile hooks, level cut loop loopers, cut/loop clips, or other gauge parts that can be mounted along a hook bar or looper bar 37, such as being mounted or cast in modules as disclosed in, for example, U.S. Pat. Nos. 7,438,007, 7,284,492, 7,597,057, and RE37,108, the disclosures of which are incorporated by reference as if fully set forth herein. The gauge parts will be reciprocated into engagement with the needles as the needles penetrate the backing B and move toward their lowered position, so as to pick up and pull the yarns from the needles for forming a series of loops of yarns in the backing material. The loops can remain as loop pile tufts, or can be cut by knives moved into engagement with cut pile hooks, level cut loop loopers, or cut/loop clips, in order to form cut pile tufts of yarns in the backing material. The yarns further can be controlled so as to substantially back-rob or pull the loops of yarns low or out of the backing.

The yarns Y can be fed to the needles 13 from one or more yarn feed attachments or mechanisms 40 mounted to the frame 16 of the tufting machine 10. The yarn feed attachment(s) 40 can include, for example, individual or single end yarn feed controls or dual end yarn feed controls, such as Infinity™ or Infinity IIE™ pattern yarn feed attachments manufactured by Card-Monroe Corp., and having a series of motor driven yarn feed devices 41, each including feed rolls 42 that feed one or two, or potentially more, yarns to selected ones of the needles. For example, yarn feed devices or systems such as disclosed in U.S. Pat. Nos. 6,807,917, 8,201,509, the disclosures of which are incorporated by reference as if set forth fully herein, can be used. In addition, other yarn feed mechanisms 40, such as standard yarn feed rolls or roll or scroll type pattern yarn feed attachments, including servomotor controlled scroll yarn feed mechanisms or other yarn feed systems, also can be used.

The yarn feed mechanisms can be operated in accordance with programming or pattern instructions for a pattern being run by the tufting machine 10 in order to control the feeding of the yarns to each of the needles 13 or to a series of needles. The feeding of the yarns can be controlled to form tufts of selected or desired pile heights, and further can be controlled so that selected yarns or loops of yarns can be substantially back-robbed or pulled low or out of the backing material, while other loops or tufts of yarns can remain in the backing material can substantially hide other loops or ends of yarns that have been back-robbed, or pulled out or low to an extent so as to be tacked into the backing but without interfering with placement of yarns or a tuft of such a stitch location. The pile heights of remaining tufts of yarns further can be controlled by control of the amount(s) of yarn fed by the yarn feed mechanism to create tufts of different heights. Thus, varying surface effects for each tuft or stitch can be formed to tuft/create textured patterns with high/low and/or shaded pattern effects, in addition to shifted or different color placement effects.

It also will be understood that while a pair of yarn feed mechanisms 40 generally is shown in FIG. 1, multiple yarn feed mechanisms or units also can be provided, mounted either along one or on both sides of the tufting machine. For example, one or more yarn feed mechanisms 40 can be mounted along the front side of the tufting machine for feeding a series of yarns to the needles of a first or upstream needle bar, and an additional set of one or more yarn feed mechanisms can be mounted on the rear or downstream side of the tufting machine for feeding a series of yarns to the needles of a downstream or second needle bar. As a further alternative, if a single needle bar is used, front and rear yarn feed mechanisms can feed yarns to alternating ones of the needles of the needle bar, e.g., the front yarn feed mechanism(s) can feed yarns to odd number needles, while the rear yarn feed mechanism(s) can feed yarns to even number needles.

Additionally, the tufting machine 10 further generally will include a control system 45 that can comprise, for example, a tufting machine controller such as a Command-Performance™ tufting machine controller as manufactured by Card-Monroe Corp. The control system 45 further can include a control processor or cabinet 46, with a user interface 47, such as a touch screen, keyboard and mouse, etc. As indicated in FIG. 1, the control system generally will be linked to the various operative elements and/or motors of the tufting machine, including the motor for the main driveshaft, as well as motors for controlling the feeding of the backing material by the backing feed and/or for controlling movement/reciprocation of the gauge parts, to the yarn feed device, or to controller(s) for the yarn feed devices 41 of the yarn feed mechanism(s) 40 and to the shift mechanism 11. The control system also can be linked to a central server and/or a design center for receiving or downloading pattern files or instructions for operation of the tufting machine to create various tufted desired or selected patterns; and/or can include design functionality or programming can be provided with a mechanism for input of pattern instructions directly at the tufting machine through the user interface.

As illustrated in FIG. 1, the shift mechanism 11 generally can be mounted along one side of the tufting machine 10. The shift mechanism 11 further generally will be coupled to drive system 20 for the needle bar 12, or to the needle bar 12, such as by a linkage or drive rod 49. While a single needle bar and shift mechanism are shown in the Figures for purposes of illustration, it will be understood that the tufting machine also can have more than one needle bar. Where multiple shifting needle bars are provided in the tufting machine, a separate shift mechanism 11 can be used for controlling the shifting or transverse movement of each of the multiple shifting needle bars, to enable control the shifting or transverse movement of each of the needle bars independently in the direction of arrows 33 and 33'. In addition, it also is possible that in some arrangements, a single shift mechanism can be utilized, connected to each of the shifting needle bars so as to shift the needles carried by each of the needle bars together, in substantially the same direction.

As further indicated in FIG. 1, the shift mechanism 11 additionally will be linked to the control system 45 and can receive control instructions therefrom so as to initiate and control the shifting of the needle bar(s) in the direction of arrows 33 and 33' to present the needles, and the particular color or type yarns carried thereby, to stitch locations across the backing in accordance with the tufted pattern being formed. For example, the needles 13 carried by the needle bar 12 can be shifted across a distance or in a series of steps or jumps that can be based upon the gauge or spacing between the needles, e.g., jumps of 1/8", 1/10", 1/16", 5/32", 5/64"; or can be shifted in multiples or fractions thereof, such as, for example, shifting the needles by multiple gauge steps (e.g., 1/4", 1/2", 1/5", etc. . . . ), by half gauge steps (e.g., 1/16", 1/20", 1/32", etc. . . . ) or by other selected amounts, including shifting the needles to an off-gauge location or position as needed or desired.

As indicated in FIGS. 2-5, the shift mechanism 11 will comprise a motor-controlled rack and pinion shift control assembly 50 that can include a housing 51, a rack 52 slidably mounted within the housing and linked to the needle bar of the tufting machine, and one or more pinions or gears 53 that are rotated in engagement with the rack so as to drive the rack in a linear movement in the direction of arrows 54/54'. The rack 52 (FIGS. 2-3B) generally will include an elongated body 56 that typically is formed from a high-strength, substantially rigid material, such as steel or other metal, or a composite or synthetic material, generally having a minimal to near-zero backlash so as to provide a substantially straight-line, linear movement in the direction of arrows 54/54', so as to provide substantially enhanced positional accuracy to the shifting movement of the needles upon engagement of the rack by the rotation of one or more pinions or gears 52. Examples of the rack 52 could include $RPS_{32}$ or $RPS_{40}$ Premium or Standard racks or a Versa Rack™, manufactured by Nexen Group, Inc.

Figure 2:
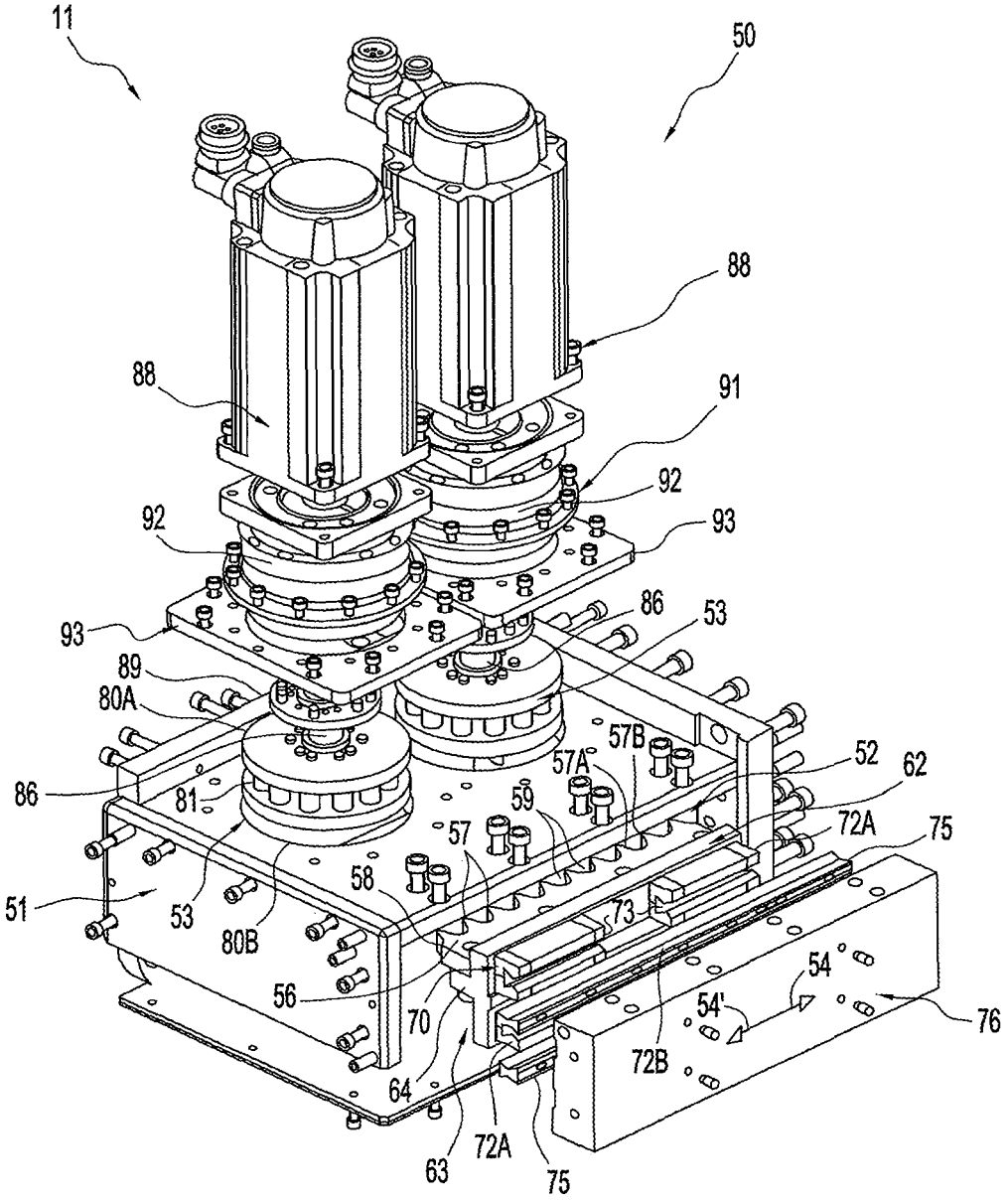
FIG. 2 is an exploded perspective of the shift mechanism according to the principles of the present invention.
Figure 3B:
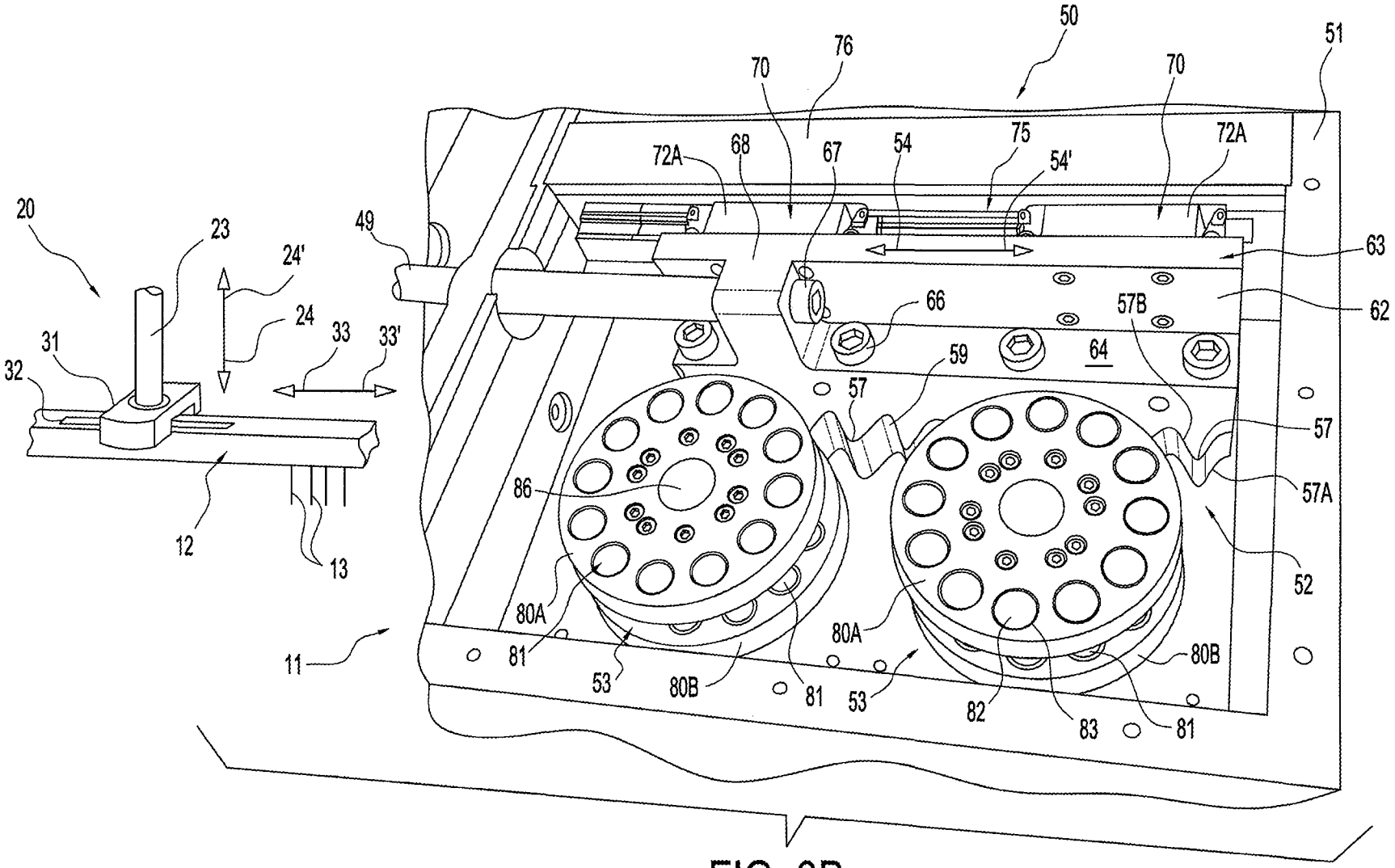
FIG. 3B is a perspective view of the rack and pinion shift control assembly of the shift mechanism.
Figure 3A:
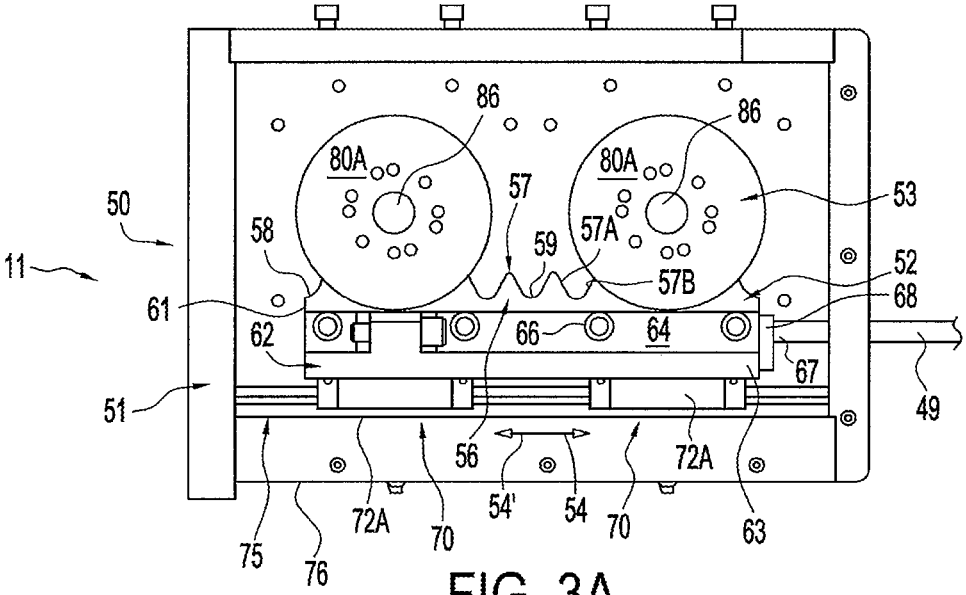
FIG. 3A is a plan view of the rack and pinion shift control assembly of the shift mechanism.

As shown in FIGS. 2-3B, a series of teeth 57 will be formed along a first or proximal side 58 of the rack body 56, with the teeth 57 each having upstream and downstream tooth faces 57A/57B defining a series of recesses or gaps 59 therebetween. As further illustrated in FIGS. 3A-3B, the second or distal side 61 of the rack body 56 generally will be mounted to a bearing or support plate 62 of a slidable rack support assembly 63. For example, the body of the rack can be received within a recess, or can be mounted on, under or along a shelf or flange 64 of the bearing plate 62, such as with fasteners 66. As the rack 52 is moved linearly, the bearing plate 62 likewise will be driven or moved linearly in the direction of arrows 54/54'. As FIG. 3B indicates, the drive rod or linkage 49 connected to the needle bar further can be coupled/mounted to the bearing plate 62 of the rack support assembly 63, such as with a first or proximal end 67 of the linkage 49 being received within a collar or yoke 68 mounted to or formed along the bearing plate 62. The linkage 49 further typically will be coupled at its opposite end to the needle bar 12 or to the drive system 20 for the needle bar, such as indicated in FIG. 1. The needle bar linkage 49 or drive rod also can be coupled more directly to the rack, or to other, intermediate drive mechanisms, in various other embodiments.

As FIG. 2 further illustrates, a series of bearing guides or brackets 70 can be mounted to a rear or distal side 71 of the bearing plate 62, opposite the rack 52. The bearing guides 70 can include linear bearing assemblies arranged along upper and/or lower body sections 72A/72B of the bearing guides 70, with a channel, recess or passage 73 being defined therebetween. Slide rail(s) 75 can be received within each passage 73 defined between the body sections 72A/72B of the bearing guides, which accordingly are supported and can slide linearly therealong during a shifting operation/movement by the rack 52. As generally illustrated in FIGS. 2 and 3A, one or more bearing guides 70 can be provided along the bearing or support plate 62 and additionally, one or more slide rails 75 further can be provided. For example, as indicated in FIG. 2, a pair of elongated slide rails 75 can be provided, spaced vertically and each mounted to a slide rail bracket or plate 76, which slide rail bracket or plate 76 can form a side wall of the housing 51 for the motor-controlled rack and pinion shift control assembly, or can be mounted to such a housing side wall; and with each slide rail 75 engaged by one or more (i.e., spaced pairs) of bearing guides 70. Greater or fewer numbers of slide rails and bearing guides also can be provided.

Figure 4A:
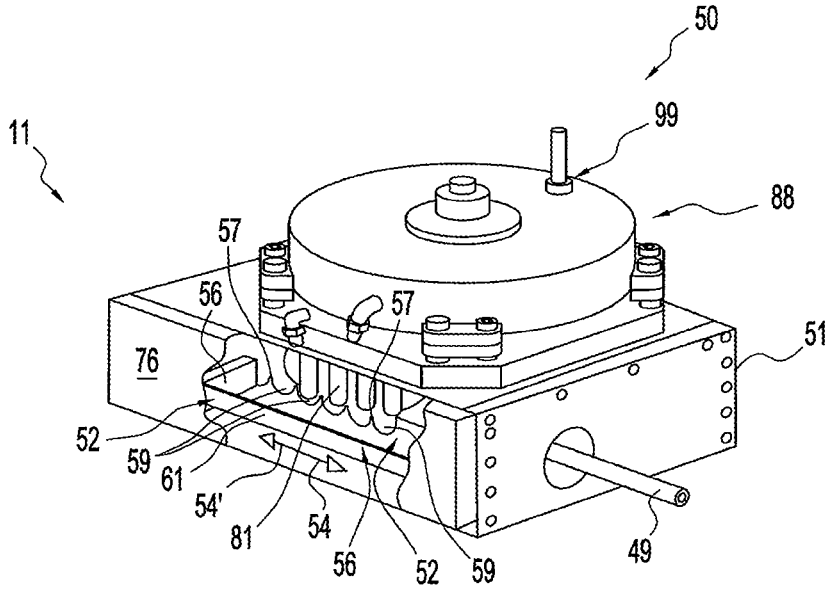
FIG. 4A is a perspective illustration, with parts broken away, of the shift mechanism with a single torque motor.

As also generally illustrated in FIGS. 2-3B, the pinions 53 can comprise roller pinions such as Nexen RPS roller pinions by Nexen Group, Inc. In some applications or embodiments, a pair of roller pinions can be used; while, alternatively, in other embodiments or applications, a single roller pinion can be provided, for example, as indicated in FIG. 4A. Each roller pinion 53 (FIG. 2) further generally will include spaced upper and lower or first and second plates 80A and 80B, between which a plurality of rollers, pins or other members or teeth 81 are mounted. The rollers 81 will be located or arranged in spaced series about the circumference of the plates 80A/80B, with the rollers being arranged in a tooth profile that substantially matches a tooth profile of the teeth of the rack 52 to provide for a substantially close engagement or fit between the rollers 81 and the pinions 53 and the teeth 57 of the rack 52 and create multiple points of between the pinions and the rack. In addition, the rollers further can be rotatably mounted between each of their pinion plates 80A/80B, with the ends 82 of each of the rollers generally being received within substantially circular openings or passages 83 that also can include bearings mounted thereabout so as to enable rotation of the rollers 81 as the rollers are received within the recesses 59 and mesh with the tooth faces 57A/57B of the rack teeth 57, as indicated in FIG. 3B.

As further illustrated in FIG. 2, each pinion generally will be mounted on a driveshaft or axle 86 rotatably mounted to the housing 51 of the motor controlled rack and pinion shift control assembly 50. The driveshafts or axles 86 of each pinion further will be coupled or connected to a driveshaft 87 of a drive motor 88. Each pinion generally also can be connected or coupled to its own associated or corresponding drive motor 88, as indicated in FIG. 2, for example, with the driveshaft 86 of each pinion being coupled or connected to the driveshaft 87 of its respective motor 88 such as by a pinion adapter 89. In addition, a gear reducer or gear box/gearhead assembly 91 can be coupled to the driveshaft of each drive motor 88 and can have an output shaft that is coupled or linked to the driveshaft of its pinion, and with a pinion preloader 92 further being mounted between each pinion adapter 89 and its gear box or gearhead assembly 91.

The motors 88, together with their gearhead or assemblies 91 and pinion preloaders 92, further generally will be mounted on and supported by motor mounting plates 93, so as to be supported along an upper portion of the housing 51 of the motor driven rack and pinion shift control assembly 50, spaced above their respective roller pinions 53 in a manner so as to not engage or otherwise hinder the rotation of the roller pinions. The motors can include servo or stepper motors, for example, synchronous, reversible, variable spaced servomotors each having an optical encoder or other position feedback sensor for providing feedback as to the rotation of the pinions, and thus the extent of the travel of the rack in response to such rotation. Each motor also will be linked to the control system 45 so as to receive instructions for controlling the rotation of their respective pinions so as to cause the linear movement of the rack 52 in the direction of arrows 54/54' as it is engaged by the pinions 53, and thus the needle bar, in a shifting motion or movement transversely across the backing material in order to shift the needles carried by the needle bar into desired stitch locations or positions across the backing for placement of tufts of yarns in accordance with the pattern being tufted.

Figure 4B:
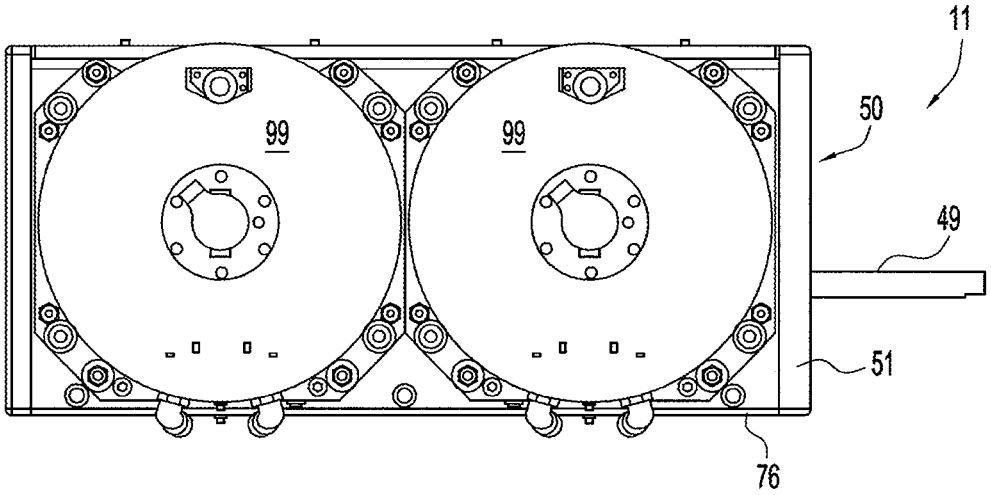
FIG. 4B is a plan view illustrating the shift mechanism with a pair of torque motors.
Figure 5:
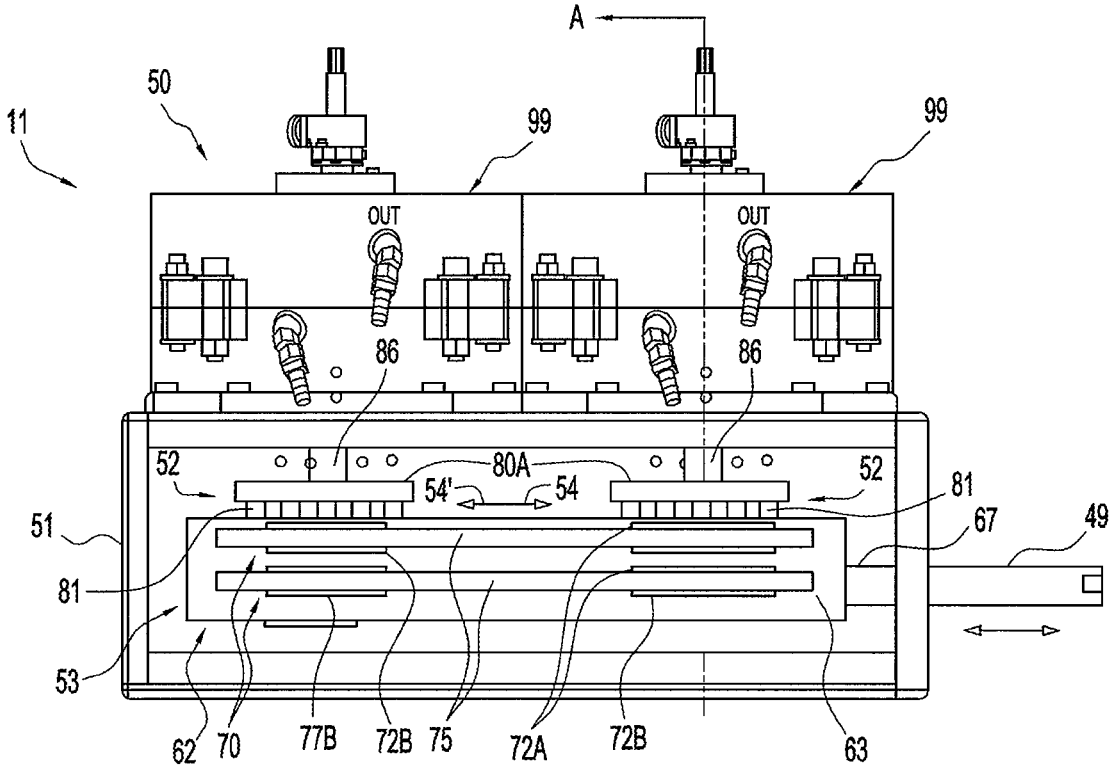
FIG. 5 is a side elevational view, with parts broken away, of the shift mechanism of FIG. 4B.

In addition, the motors 88 further can comprise torque motors 99, as illustrated in FIGS. 4A-5. The use of torque motors 99 can provide for increased torque, such as at the start of a shifting operation, sufficient to overcome an initial inertia due to the mass of the needle bar and needles when the needle bar is either at a standstill or stopped position or when moving it is in an opposite direction. The torque provided by the torque motors further can be controlled during the shifting operation to control the stopping/braking or for substantially slowing the transverse movement of the needle bar substantially at or near the end of a transverse shifting movement or cycle of the needle bar to further help provide for enhanced positional accuracy of the shifting of the needles with respect to the pattern stitch locations at which the needles are to place the yarns carried thereby.

The use of the torque motors in conjunction with the rack and pinion mechanism of the motor control rack and pinion shift control assembly 50 thus can help provide substantially enhanced control of the starting and stopping and movement of the needle bar to help provide increased or enhanced positional accuracy of the presentation of the needles as the needles are shifted between stitch or tuft locations as required by the pattern instructions for the pattern being formed by the tufting machine, and further can enable the shifting of the needles with such enhanced positional accuracy at an increased rate. For example, during the formation of a tufted article such as a tufted carpet or rug, the needles 13 (FIG. 1) can be shifted in the direction of arrows 33 and 33' by the motor driven rack and pinion shift control assembly 50, with the shifting of the needles being initiated at a point closer to when the needles are being withdrawn from or are clearing the backing material and can be shifted or moved transversely by a desired number of shift steps/jumps (e.g., one, two, or more steps), or by a selected distance as needed to align the needles with a next stitch location of the pattern to be tufted in the backing; and with the movement of the needles to their new stitch locations being initiated and stopped by the motor controlled rack and pinion shift control assembly with substantially enhanced precision. As the time required to shift the needles laterally to their next stitch locations as called for by the pattern being formed is reduced or substantially controlled, the rate at which the needles are reciprocated vertically or driven to form such tufts of yarns in the backing correspondingly can be increased, without significantly or substantially affecting the precision and accuracy of the pattern being formed.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A tufting machine, comprising:

backing feed rolls feeding a backing material through the tufting machine;

at least one needle bar having a series of needles mounted therealong, at least some of the needles carrying yarns therewith as the needles are reciprocated into and out of the backing material for forming tufts of yarns in the backing material; and a shift mechanism coupled to the at least one needle bar and controlling movement of the at least one needle bar to shift the needles across of the backing material, the shift mechanism comprising:

a rack linked to the at least one needle bar;

at least one rotatable pinion configured to engage one or more teeth of the rack as the at least one pinion is rotated; and a motor coupled to the at least one pinion, for driving rotation of the at least one pinion in one or more directions so as to cause the rack to move linearly for shifting the needles across the backing material.

2. The tufting machine of claim 1, further comprising a yarn feed mechanism controlling feeding the yarns to the needles.

3. The tufting machine of claim 1, wherein the at least one pinion comprises a pair of pinions spaced from each other and arranged to engage with the teeth of the rack at multiple points of contact; and further comprising a pair of motors, each engaging one of the pair of pinions.

4. The tufting machine of claim 1, wherein the shift mechanism further comprises a sliding bracket mounted to the rack with at least one bearing guide mounted along the sliding bracket, and at least one track or rail received within the bearing guide and along which the sliding bracket is moved; and a linkage connecting the sliding bracket or rack to the at least one needle bar for communicating movement of the rack to the at least one needle bar to shift the at least one needle bar transversely with respect to the backing material.

5. The tufting machine of claim 1, further comprising a series of gauge parts arranged below the backing material and reciprocated into engagement with at least some of the needles as the needles are engaged with the backing material to pick loops of yarns therefrom for forming the tufts of yarns in the backing material.

6. The tufting machine of claim 1, further comprising a pinion preloader connected to the at least one pinion, and a gear head assembly coupled to the pinion preloader and to a driveshaft of the motor.

7. The tufting machine of claim 1, wherein the motor comprises a torque motor or a reversible servo motor.

8. The tufting machine of claim 1, wherein the at least one needle bar comprises a pair of independently shiftable needle bars, and further comprising a pair of shift mechanisms, each coupled to one of the pair of needle bars for shifting each of the needle bars across the backing material.

9. A tufting machine for forming a series of tufts of yarns in a backing in accordance with a selected pattern, the tufting machine comprising:

a series of spaced needles mounted along one or more needle bars and carrying the yarns into and out of the backing as the needles are reciprocated into and out of the backing;

a series of gauge parts arranged below the backing and reciprocable toward engagement with the needles as the needles are reciprocated into the backing, the gauge parts configured to pick loops of yarns from at least some of the needles for forming tufts of yarns in the backing; and a shift mechanism coupled to at least one needle bar of the one or more needle bars and comprising:

a rack linked to the at least one needle bar and having a series of teeth arranged therealong;

at least one pinion engaging one or more of the teeth of the rack; and a motor connected to the at least one pinion, the motor driving rotation of the pinion, in response to which the rack is driven linearly so as shift the needles transversely across the backing.

10. The tufting machine of claim 9, wherein the one or more needle bars comprise a pair of independently shiftable needle bars, and wherein a separate shift mechanism is coupled to each one of the needle bars of the pair of needle bars.

11. The tufting machine of claim 9, wherein the motor comprises a torque motor or a servo motor.

12. The tufting machine of claim 11, further comprising a pinion preloader connected to the at least one pinion, and a gear head assembly coupled to the pinion preloader and to a driveshaft of the motor.

13. The tufting machine of claim 9, wherein the at least one pinion comprises a series of teeth or rollers for engaging the rack at multiple points of contact as the at least one pinion is rotated.

14. The tufting machine of claim 9, wherein the at least one pinion comprises a pair of pinions arranged at spaced locations so as to engage the rack at multiple points of contact.

15. The tufting machine of claim 14, wherein the shift mechanism further comprises a sliding bracket mounted to which the rack, with at least one bearing guide mounted to the sliding bracket and at least one track or rail engaged by the at least one bearing guide for guiding movement of the sliding bracket therealong and move the rack linearly; and a linkage connected to the sliding bracket or the rack and to the at least one needle bar for translating the linear movement of the rack to the at least one needle bar to cause the at least one needle bar to be shifted transversely with respect to the backing.

* * * * *